US011291884B1

(12) United States Patent
Steele

(10) Patent No.: US 11,291,884 B1
(45) Date of Patent: Apr. 5, 2022

(54) ANKLE BOX SYSTEM, RISER AND METHOD OF USING THE SAME

(71) Applicant: Rocky Steele, Henderson, NV (US)

(72) Inventor: Rocky Steele, Henderson, NV (US)

( * ) Notice: Subject to any disclaimer, the term of this patent is extended or adjusted under 35 U.S.C. 154(b) by 202 days.

(21) Appl. No.: 16/682,692

(22) Filed: Nov. 13, 2019

(51) Int. Cl.
*A63B 23/08* (2006.01)
*A63B 21/00* (2006.01)
*A63B 23/04* (2006.01)

(52) U.S. Cl.
CPC ..... *A63B 23/08* (2013.01); *A63B 21/4034* (2015.10); *A63B 23/0458* (2013.01); *A63B 2208/0204* (2013.01); *A63B 2225/093* (2013.01)

(58) Field of Classification Search
CPC ..... A63B 23/08; A63B 21/40; A63B 23/045; A63B 2208/02; A63B 2225/093
See application file for complete search history.

(56) References Cited

U.S. PATENT DOCUMENTS 3,399,407 A * 9/1968 Olsen ..... A63B 6/02 482/15
5,005,702 A * 4/1991 Davis ..... A47B 23/002 108/43
5,154,678 A * 10/1992 Adamczyk ..... A63B 23/0458 108/90
5,907,913 A * 6/1999 Kock ..... A61H 3/00 36/132
6,558,301 B1 * 5/2003 Jackson ..... A63B 21/0552 482/121
6,908,417 B2 * 6/2005 Jackson ..... A63B 21/0552 482/123
7,008,359 B2 * 3/2006 Fan ..... A63B 22/18 482/146
7,044,558 B2 * 5/2006 Chiu ..... A47C 4/54 297/217.1
D560,260 S * 1/2008 Flentye ..... D21/671
7,431,681 B1 * 10/2008 St. Cyr ..... A63B 21/0552 482/121
7,601,101 B2 * 10/2009 Jackson ..... A63B 21/04 482/142
7,824,319 B2 * 11/2010 Carlesimo ..... A63B 26/00 482/141

(Continued)

OTHER PUBLICATIONS

Asbjørn Roaas and Gunnar B. J. Andersson, "Normal Range of Motion of the Hip, Knee and Ankle Joints in Male Subjects, 30-40 Years of Age," Acta Orthopaedica Scandinavica, 1982, 53:2, pp. 205-208.

(Continued)

*Primary Examiner* — Garrett K Atkinson
(74) *Attorney, Agent, or Firm* — Weide & Miller, Ltd.

(57) ABSTRACT

An ankle box system includes at least one ankle box and a riser. Each of the ankle boxes has an upper surface and a lower surface, and a plurality of projections extending from the lower surface, such as at the ends thereof. The riser has a bottom surface and a plurality of riser levels, each of the riser levels configured for selectively receiving one of the projections of at least one of the ends of an ankle box, at least two of the riser levels having an upper surface being disposed at different elevations from a bottom surface of the riser. The upper surfaces of the ankle boxes have a shape configured to enhance exercising the human ankle.

19 Claims, 6 Drawing Sheets

(56) References Cited

U.S. PATENT DOCUMENTS 7,927,256 B2 * 4/2011 Flentye ..... A63B 23/0458 482/52
8,246,521 B2 * 8/2012 Alexander ..... A63B 69/0053 482/8
8,348,812 B2 * 1/2013 Elpers ..... A63B 23/0458 482/52
D681,138 S * 4/2013 Hodgkins ..... D21/686
8,696,523 B2 * 4/2014 Elpers ..... A63B 23/04 482/52
8,915,825 B2 * 12/2014 Elpers ..... A63B 23/04 482/52
D737,385 S * 8/2015 Woniger ..... D21/671
9,272,173 B2 * 3/2016 Kempka ..... A63B 5/16
10,045,647 B2 * 8/2018 Publicover ..... A63B 21/068
10,434,357 B2 * 10/2019 McCarthy ..... A63B 21/0552
10,926,122 B2 * 2/2021 Hausheer ..... A63B 71/0036
11,040,237 B2 * 6/2021 Park ..... A63B 23/0458
2004/0002411 A1 * 1/2004 Jackson ..... A63B 21/0552 482/121
2006/0052220 A1 * 3/2006 Jackson ..... A63B 21/04 482/52
2006/0189448 A1 * 8/2006 Flentye ..... A63B 23/0458 482/52
2006/0189449 A1 * 8/2006 Flentye ..... A63B 23/0458 482/52
2006/0248817 A1 * 11/2006 Elwood ..... E04F 11/1043 52/182
2006/0272230 A1 * 12/2006 Elwood ..... A63B 71/02 52/182
2009/0233740 A1 * 9/2009 Gensler ..... A63B 69/0002 473/497
2010/0120587 A1 * 5/2010 Alexander ..... A63B 21/00047 482/52
2011/0172063 A1 * 7/2011 Flentye ..... A63B 23/0458 482/52
2014/0100086 A1 * 4/2014 Pagliaro ..... A61H 1/0266 482/91
2015/0196799 A1 * 7/2015 Chua ..... A63B 23/1236 482/141
2017/0050101 A1 * 2/2017 Ruscombe-King ..... A63B 21/00047
2017/0056745 A1 * 3/2017 Stacey ..... A63B 21/0084
2017/0172331 A1 * 6/2017 Publicover ..... A63B 26/003
2018/0085623 A1 * 3/2018 Flook ..... A63B 1/00
2018/0229098 A1 * 8/2018 McCorkle ..... A63B 71/0054
2018/0271735 A1 * 9/2018 Drucker ..... A63B 21/00047
2018/0360250 A1 * 12/2018 Publicover ..... A63B 21/0602
2019/0160322 A1 * 5/2019 McCarthy ..... A63B 21/025
2019/0168051 A1 * 6/2019 Hausheer ..... A63B 5/00
2019/0336813 A1 * 11/2019 Park ..... A63B 21/00047
2019/0374813 A1 * 12/2019 Softer ..... A63B 1/00
2021/0052936 A1 * 2/2021 Park ..... A63B 21/00047

OTHER PUBLICATIONS

Tadeusz Starzynski and Henryk Sozanski, "Explosive Power and Jumping Ability for All Sports," Dec. 18, 2016, 5 pages.

* cited by examiner

ANKLE BOX SYSTEM, RISER AND METHOD OF USING THE SAME

FIELD OF THE INVENTION

The present invention relates to an ankle and lower extremity joint box system, a riser and a progressive method of using the same, configured to strengthen the human ankle, its ligaments, muscles and accompanied joints and connective tissue.

BACKGROUND OF THE INVENTION

The ankle joint bears the most weight of any joint in the human body. The ankle is often injured when jumping, running, walking, etc. The ankle is subject to a variety of injuries, such as ankle fractures, twisting or spraining, which can be quite painful and debilitating. Lack of appropriate ankle mobility negatively impacts the ability to walk, run, stand and most every locomotion. Over time this lack of mobility can create additional injury up the kinetic chain, affecting the knee, hip and back.

The human ankle and associated ligaments can be strengthened to decrease the risk of injury. Typical exercises include inversion, eversion, abduction, flexion of the ankle, circular movements and so forth. However, most of the population does not know the appropriate exercises or the degree or progression to which these exercises should be performed. Additionally, people do not typically have access to a safe and stable apparatus that can be used to facilitate exercising of the ankle, including the progression of moving the ankle into desired positions.

What is needed is an apparatus and method that makes ankle exercises easier, safer and more efficient to perform, while also allowing for easy incremental adjustment of the angles applied to the ankle through the progression of the exercise.

All the built-in angles, elevations and grades achieved by the ankle boxes of the present invention, along with the additional degrees achieved with the riser, relative to the ankles range of motion are within the standards and comportment of a rare independent study with standard deviation done by Asbjørn Roaas & Gunnar B. J. Andersson (1982), titled *Normal Range of Motion of the Hip, Knee and Ankle Joints in Male Subjects,* 30-40 *Years of Age*, Acta Orthopaedica Scandinavica, 53:2, 205-208, DOI: 10.3109/17453678208992202. Cited within the article is also a range of ankle mobility by The American Academy of Orthorpaedic Surgeons, which identifies appropriate ranges of ankle mobility also within the Box Systems range. The lone exception is the extreme plantar flexion which is not typical and usually a specialized range achieved by ballet and dance athletes (available at https://doi.org/10.3109/17453678208992202).

SUMMARY OF THE INVENTION

Aspects of the invention comprise one or more ankle boxes, a riser, and an ankle box system comprising multiple ankle boxes or at least one ankle box and a riser.

Each of the ankle boxes has an upper surface and a lower surface, and a plurality of projections extending from the lower surface. Each ankle box is configured to support one or both feet of a user on the upper surface thereof, such as for performing various ankle-related exercises. The configuration of the upper surfaces of the ankle boxes may vary, such as by being convex, concave, V-shaped or inverted V shaped.

The riser has a bottom surface and a plurality of riser levels, one or more of the riser levels configured for selectively receiving the projection(s) an at end of one of the ankle boxes, wherein two or more of the riser levels have an upper surface being disposed at a different elevations above the bottom surface of the riser.

The riser levels may each include an inner side wall and an outer side wall extending upward from an upper surface of the riser level, whereby the riser level is configured as a slot for retaining the projection(s) at an end of the ankle box therein. The riser levels and adjacent surfaces may be sloped to match the slope of an ankle box placed thereon.

In one embodiment, a system comprises two or more ankle boxes. The ankle boxes might be the same or have different upper surface configurations. In another embodiment, a system comprises at least one ankle box and a riser, such as a set of two or four ankle boxes and a riser.

Two or more of the ankle boxes may have complimentary shapes, allowing them to be stacked. In one embodiment, the shapes of two or more of the ankle boxes are complimentary in an inverted position, such as where an ankle box having a convex upper surface may be inverted and placed into complimentary position with an ankle box having a concave upper surface.

In accordance with another aspect of the invention, a method of utilizing a riser with at least one ankle box is provided. The method includes raising one end of an one ankle box and placing the projection(s) at the end of the ankle box onto one of the upper surfaces of the ankle box (such as into one of the slot thereof), such that the one end of the ankle box is raised from a surface on which another end of the ankle box is disposed, and performing ankle exercises on the ankle box.

Further objects, features, and advantages of the present invention over the prior art will become apparent from the detailed description which follows, when considered with the figures provided herein.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises one or more exercise platforms or boxes, and a system including one or more of such boxes and/or a riser. The exercise platforms are particularly configured for exercising a human ankle (including both ankles of a user when a user when a user has both feet on the ankle box), and are thus referred to herein as "ankle boxes". The ankle box system may include at least one ankle box and a riser. The ankle boxes may be configured to assist a user in performing ankle-related exercises. The riser may be configured to include a plurality of levels to which one end of an ankle box may be raised, thereby changing the position of the ankle box, such as to change an effective angle or slope the ankle box presents to a user.

Figure 1:
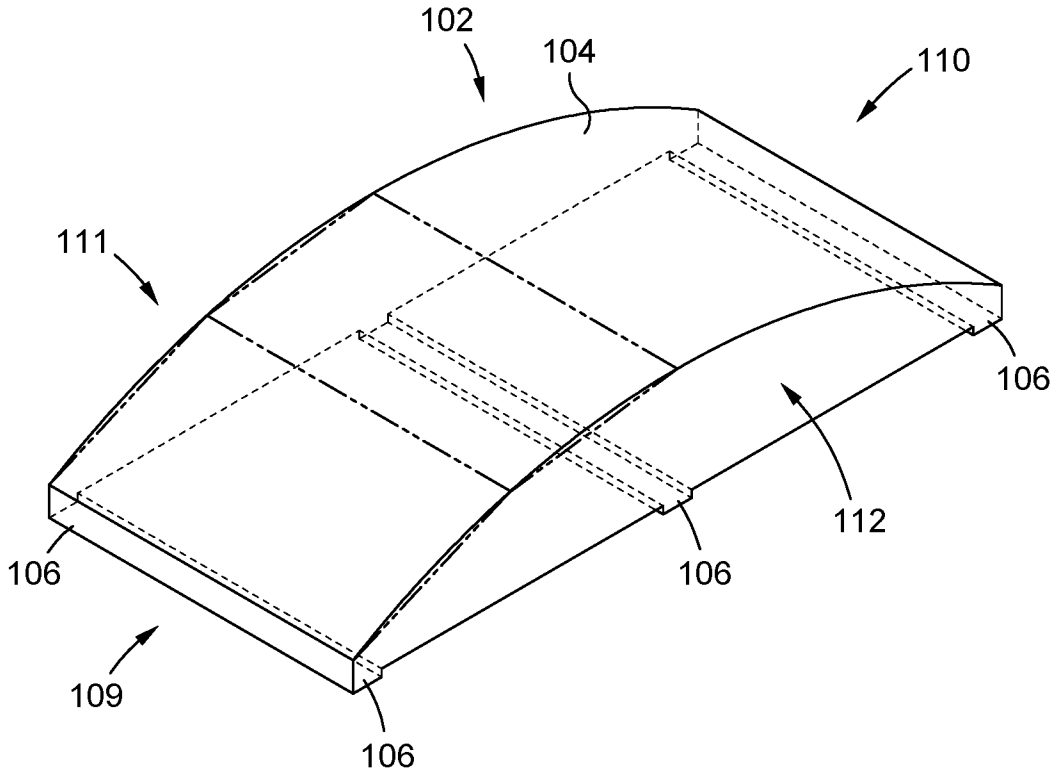
FIG. 1 is a perspective view of an ankle box in accordance with a first embodiment of the invention.
Figure 2:
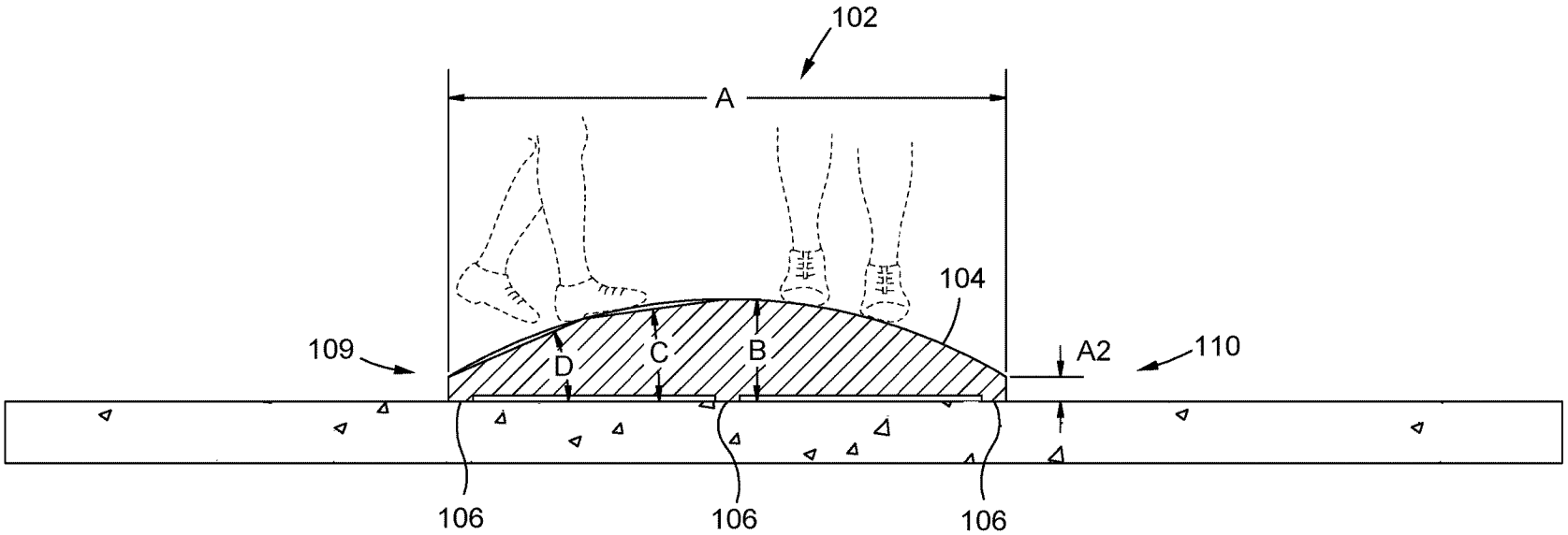
FIG. 2 is a side view of the ankle box illustrated in FIG. 1.

As illustrated in FIG. 1, in one embodiment, the ankle box 102 has a first end 109 and an opposing second end 110. The ankle box 102 has a first side 111 and an opposing second side 112. As illustrated in FIG. 2, the ankle box 102 has a top which comprises or defines an upper surface 104 (which may be referred to herein as the exercise surface or supporting surface), and has a bottom or lower surface 105. The lower surface is configured to rest on a surface, such as a floor or, as described in more detail below, a riser.

In the embodiment illustrated in FIGS. 1 and 2, the ankle box 102, and namely the upper surface 104, has a generally convex shape. As such, this embodiment ankle box 102 may be referred to as a convex ankle box. In such a configuration, the elevation of the upper surface 104 relative to the bottom or lower surface 105 is a first distance at the first and second ends 109, 110, and is a second larger distance therebetween, such as at a midpoint between the ends.

In one embodiment, as illustrated in FIG. 2, the distance A (from the first end 109 to the second end 110) may be 45½ inches, the distance A2 (the height of the upper surface 104 at the first and second ends 109, 110) may be 2 inches, and the distance B (the second distance or height of the upper surface 104 between the ends) may be 8⅜ inches. In one embodiment, the upper surface 104 has a smooth radius or arc, wherein in the embodiment illustrated, a distance C may be 7.8 inches and angle D may be 23.4 degrees. These and all other distances and angles described herein are only example measurements used in an embodiment of the invention, and other distances and measurements may be used without departing from the scope of the claims.

The bottom surface 105 of the ankle box 102 may have a plurality of projections or feet 106 extending downwardly therefrom. The projections or feet 106 may be disposed at the ends of the ankle box 102. Additionally, the projections 106 may include a projection at a central portion of the ankle box 102. The projections 106 may extend along an entire width (e.g. from the first side 111 to the second side 112) of the ankle box 102, or may extend only along a portion of the width, such as comprising feet at the corners and mid-points of the sides. Any number of projections 106 may be used.

The ankle box 102 may be constructed in a variety of manners and from a variety of materials. As one example, the ankle box 102 might be constructed from a pair of side panels (wherein the panels may be cut to include the projections or feet 106), such as cut from plywood, and a top which is connected to and supported by the sides. The top might, for example, comprise a piece of plywood that is steamed or hydrated and then placed onto a curved jig in order to bend the plywood into the desired arc shape.

Of course, in other embodiments, the ankle box 102 might be formed of other materials to include but not limited to plastic, composite, fiberglass, metal or any combination thereof and in other manners. As one example, the ankle box 102 might comprise multiple molded plastic members or be molded as a single member.

Also, the top or upper surface might comprise or include a non-slip surface or material.

As described in more detail below, the upper surface 104 of the ankle box 102 defines an arcuate surface which a user may engage. For example, a user may walk, hop, run or the like, across or along the upper surface 104 (including while carrying objects, such as weights). The user might orient their feet so that they are parallel to the lengthwise (e.g. end to end) direction of the ankle box 102 as illustrated at the left-side of the ankle box 102 in FIG. 2, or perpendicular thereto (e.g. in the side-to-side direction), as illustrated at the right-side in FIG. 2. In particular, the arcuate shape of the upper surface 104 allows a user to stand on the upper surface 104 and cause their ankle or ankles (e.g. the orientation of the ankle joint between a foot and leg) to be placed in a variety of orientations.

Figure 3:
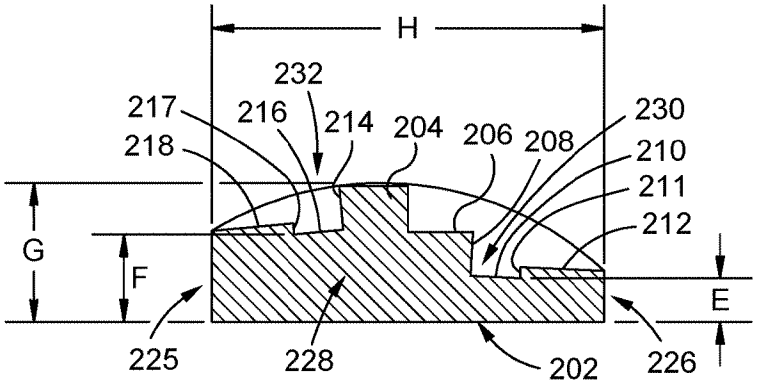
FIG. 3 illustrates a riser in accordance with an embodiment of the invention, viewed in direction 3-3 in FIG. 5.
Figure 5:
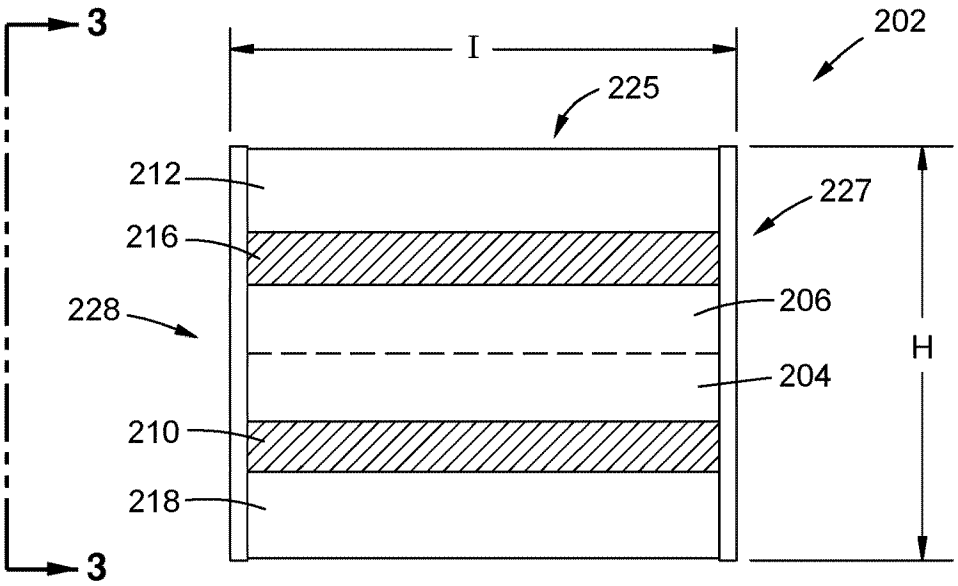
FIG. 5 illustrates a top view of a riser in accordance with embodiments of the invention.

FIGS. 3 and 5 illustrates a riser 202 in accordance with embodiments of the invention. As described in more detail below, the riser 202 may be used to change the position or orientation of one or more ankle boxes.

In one embodiment, the riser 202 has a top and a bottom. In one embodiment, the bottom may comprise a substantially flat lower surface, and the top may comprise a plurality of upper surfaces. As best illustrated in FIG. 5, in one embodiment, the riser 202 may be quadrilateral in peripheral shape, having a first end 225 and an opposing second end 226, and a first side 227 and an opposing second side 228, wherein the ends and sides are generally perpendicular to one another. However, the riser 202 might have other shapes.

In the embodiment of FIGS. 3 and 5, the riser 202 includes five upper surfaces 204, 206, 210, 212, 216 and 218, although a different number of upper surfaces could be provided. Each of the upper surfaces may be disposed at different distances from the lower surface (in this case, elevations above the lower surface). The upper surfaces 204, 206, 210, 212, 216 and 218 along with associated side surfaces (such as side surfaces 208 and 214) form a series of tiers, which may each have an upper surface at different distances from the lower surface of the riser 202. In one embodiment, the riser 202 may have a distance or elevation E of 2 inches, a distance F of 4 inches, and a distance G of 6⁵⁄₁₆ inches.

The riser 202 may have a length H (measured from the first end 225 to the second end 226) which is slightly greater than a width I (measured from the first side 227 to the second side 228) of the projections 106 of the ankle box 102. For example, the distance H may be 18 inches and distance I may be 22 inches. In one embodiment, each level extends across the width of the riser 202 from the first side 227 to the second side 228.

Additionally, at least some of the upper surfaces, such as upper surfaces 210, 212, 216 and 218 may be formed with a downward angle or slope (as measured from a center of the riser 102 outward towards one of the ends thereof), for reasons explained below.

The upper surfaces 210 and 216 of the riser 202 are configured as levels for receiving an end of an ankle box, and most preferably, the projections thereof (such as projections 106 of the convex ankle box 102). As indicated, the upper surface 210 is inset (i.e. lower than) the adjacent upper surfaces 204 and 218, whereby the upper surface 210 comprises a first slot 230 having side surfaces or walls 208 and 218. The upper surface 216 similarly is inset relative to the adjacent upper surfaces 206 and 212, whereby the upper surface 216 comprises a second slot 232 having side surfaces or walls 214 and 217.

Similar to the ankle box, the riser 202 might be formed in various manners and from various materials, including by molding.

Figure 4:
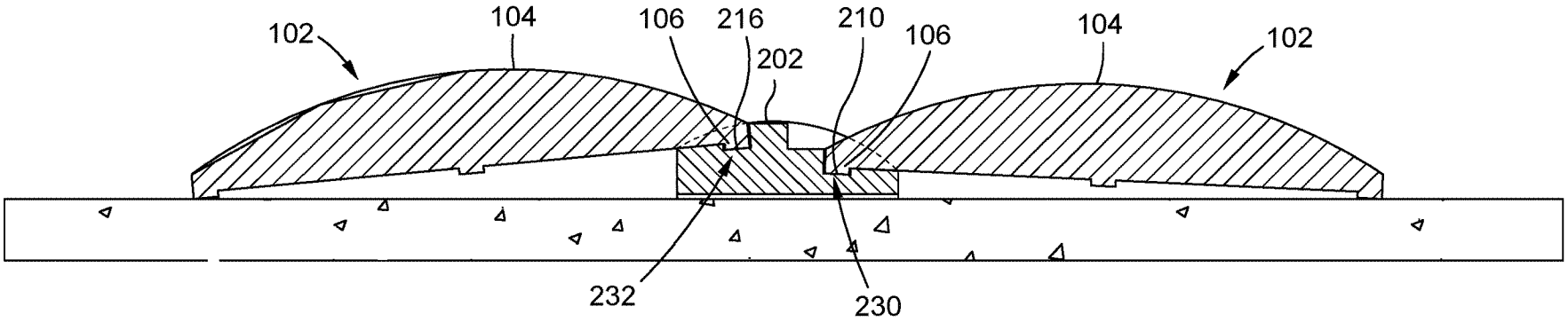
FIG. 4 illustrates a system including a riser and ankle boxes in accordance with the first embodiment of the invention.

FIG. 4 illustrates a system 302 in accordance with another aspect of the invention. The system 302 includes a plurality of ankle boxes 102 and a riser 202. The ankle boxes 102 of FIG. 4 are shown as having the same configuration as the ankle box 102 illustrated in FIGS. 1 and 2, but as described in more detail below, they might have other configurations (and be the same or different).

In FIG. 4, the ankle boxes 102 are illustrated with one end of each ankle box 102 lifted onto the riser 202. The ankle box 102 shown on the right in FIG. 4 has its leftmost end and associated projection 106 lifted off a floor and disposed in the first slot 230. As indicated above, the width of the first slot 230 between the sidewalls 204 and 218) is greater than the length of the projections 106, such that the projections 106 can fit into the first slot 230 and be retained therein by the sidewalls 204 and 218 adjacent thereto. Likewise, the ankle box 102 on the left side in FIG. 3 has its rightmost end and associated projection 106 disposed in the second slot 232 of the riser 202.

At any given time, either zero (0), one (1) or two (2) ankle boxes may be supported by the riser 202, by engaging the projection 106 at an end of each ankle box with one of the slots 230, 232 of the riser 202. The upper surfaces 210 and 216 are configured to be at different levels or elevations from the bottom surface of the riser 202, such that a user can chose which of the upper surfaces 210 or 216 to place the projection of the ankle box 102 on, thus determining a height the end of the corresponding ankle box 102 is lifted or raised off of the floor (and thus raised above the other end of the ankle box).

The upper surfaces 210, 212, 216 and 218 may be all configured to have a downward angle or slope relative to horizontal, from a center of the riser 202 outward towards the ends of the riser. The slope of angle of these surfaces may correspond to an angle of the ankle box (wherein the downward angle of the upper surfaces may thus be dependent upon the length of the ankle box, which defines the slope of the box when it engages the riser 202). In this regard, the downward angle or slope of the upper surfaces 216 and 218 may be greater than the downward angle or slope of upper surfaces 210 and 212 because distance F (the height of the upper surface 216 in the second slot 232) is greater than distance E (the height of the upper surface 210 in the first slot 230). The upper surfaces 212, 218 may contact the bottom of an ankle box 102 resting on the riser 202.

Figure 6:
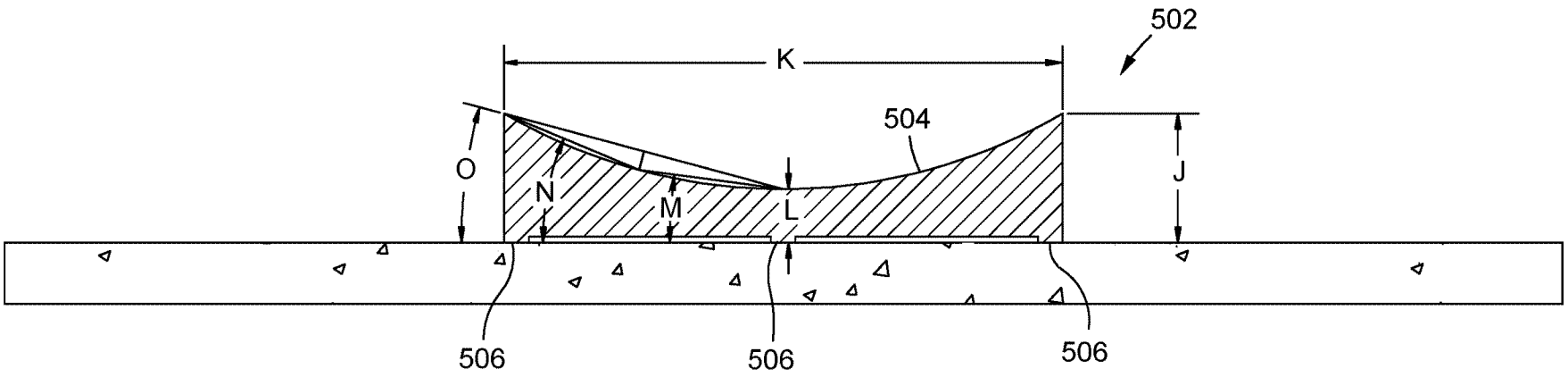
FIG. 6 illustrates an ankle box in accordance with a second embodiment of the invention.

FIG. 6 illustrates an ankle box 502 in accordance with another embodiment of the invention. The ankle box 502 again has a top, a bottom, opposing sides, and projections 506 extending from the bottom. In contrast to the ankle box 102 illustrated in FIGS. 1 and 2, the top of this ankle box 506 has an upper surface 504 that is concave (again, preferably being arcuate in shape). As such, this ankle box 502 may be referred to as a concave ankle box.

In one embodiment, referring to FIGS. 6 and 67 a distance J may be 10½ inches. A distance K may be 45½ inches. A distance L (from the top surface 504 to the bottom of the projection 506 at the center of the ankle box 506) may be 4⅜ inches. Angle M may be 7.5 degrees, measured from a line extending from a center of the top surface 504 of the ankle box 502 to a point half-way between the center and the left end of the ankle box 502. Angle N may be 22.6 degrees, measured from a line extending from the point half-way between the center and the left edge of the ankle box 502 to the left end of the ankle box 502. Angle O may be 15.1 degrees, measured from a line extending from the center of the top surface 504 of the ankle box 502 to a top left end of the ankle box.

Figure 7:
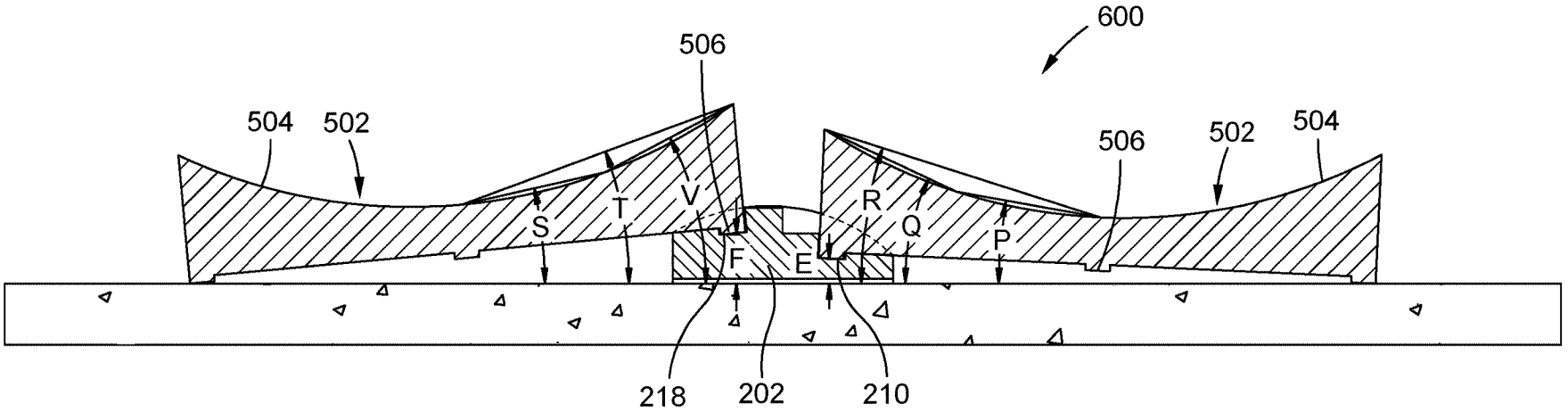
FIG. 7 illustrates a system including a riser and ankle boxes in accordance with the second embodiment of the invention.

FIG. 7 illustrates a system 602 in accordance with another aspect of the invention. The system 602 includes two of the ankle boxes 502 and a riser 202. The riser 202 has the same configuration as the riser 202 of FIGS. 3 and 5. The ankle boxes 502 have a same configuration as the ankle box 502 illustrated in FIG. 6.

In a similar manner to the system 302 illustrated in FIG. 4, the system 602 allows a user to raise one end of each ankle box 502 by lifting a right or left end of the ankle box 502 and placing the projection 506 at that end onto the riser 202 (and preferably onto upper surface 210 in the slot 230 or onto upper surface 216 in the slot 232). In the embodiment illustrated, the right or left ends of the ankle boxes 502 can be raised by distance E of 2 inches or distance F of 4 inches.

When the ankle box 502 is raised 2 inches, as shown by the rightmost ankle box 502 in FIG. 7, angle P becomes 10.5 degrees, angle Q becomes 25.2 degrees and angle R becomes 17.2 degrees. When the ankle box 502 is raised 4 inches, as shown by the leftmost ankle box 502 in FIG. 7, angle S becomes 12.8 degrees, angle T becomes 20.4 degrees and angle U becomes 27.9 degrees.

Figure 8:
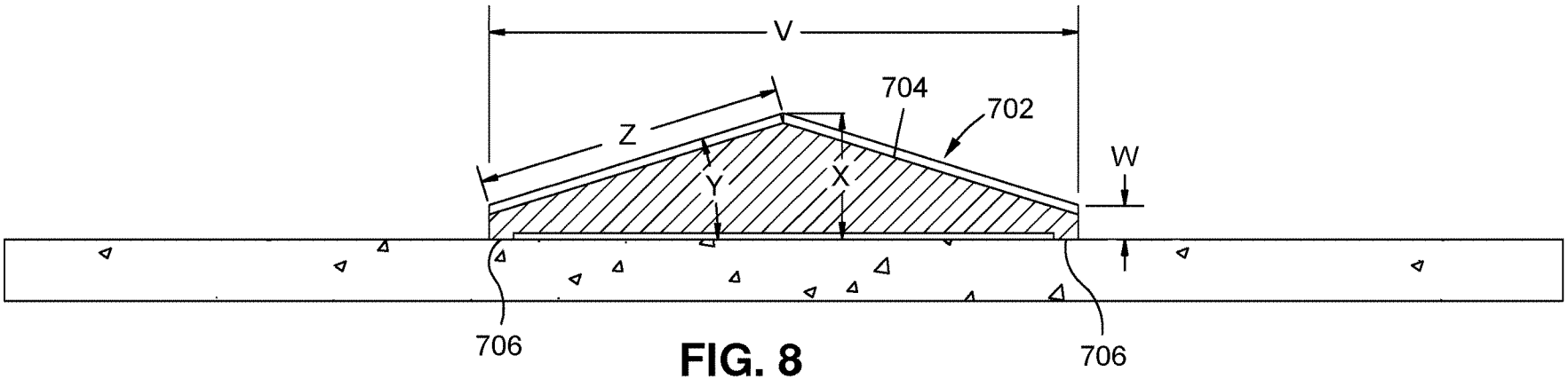
FIG. 8 illustrates an ankle box in accordance with a third embodiment of the invention.

FIG. 8 illustrates an ankle box 702 in accordance with another embodiment of the invention. The ankle box 702 again has a top, a bottom, opposing sides, and projections 706 extending from the bottom. In contrast to the ankle box 102 illustrated in FIGS. 1 and 2, the top of this ankle box 706 has an upper surface 704 that is triangular in shape, with a first half from a left side to a center of the ankle box 702 having an upwardly extending (and in one embodiment, generally constant) slope, and a second half (from the center to the right side) having a downwardly extending (and in one embodiment, generally constant) slope. This ankle box 702 may thus be referred to as a triangular or inverted V ankle box.

Figure 9:
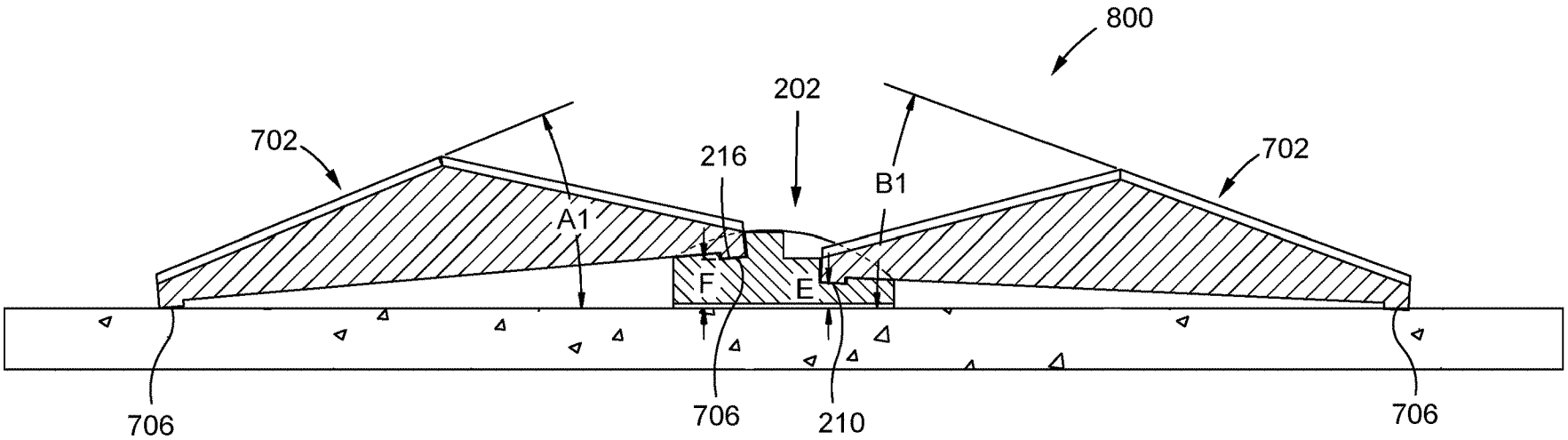
FIG. 9 illustrates a system including a riser and ankle boxes in accordance with the third embodiment of the invention.

In one embodiment, referring to FIGS. 8 and 9, a distance V may be 48 inches. A distance W may be 2¾ inches. A distance X may be 10⁵⁄₁₆ inches. An angle Y may be 17.4 degrees.

FIG. 9 illustrates a system 802 in accordance with another embodiment of the invention. The system 802 includes two of the ankle boxes 702 and a riser 202. The riser 202 has a same configuration as the riser 202 of FIGS. 3 and 5. The ankle boxes 702 have a same configuration as the ankle box 702 illustrated in FIG. 8.

In a similar manner to the system 302 of FIG. 4 and the system 602 of FIG. 7, the system 802 allows a user to raise one end of the ankle boxes 702 by lifting a right or left end of the ankle box 702 and placing the associated projection 706 onto the riser 202 (and preferably onto upper surface 210 in the slot 230 or onto the upper surface 216 in the second slot 232). In the embodiment illustrated, the right or left ends of the ankle boxes 702 can be raised by distance E of 2 inches or distance F of 4 inches.

When one end of the ankle box 702 is raised 2 inches, as shown by the rightmost ankle box 702 in FIG. 9, angle B1 becomes 20.1 degrees. When one end of the ankle box 702 is raised 4 inches, as shown by the leftmost ankle box 702 in FIG. 9, angle A1 becomes 22.4 degrees.

Figure 10:
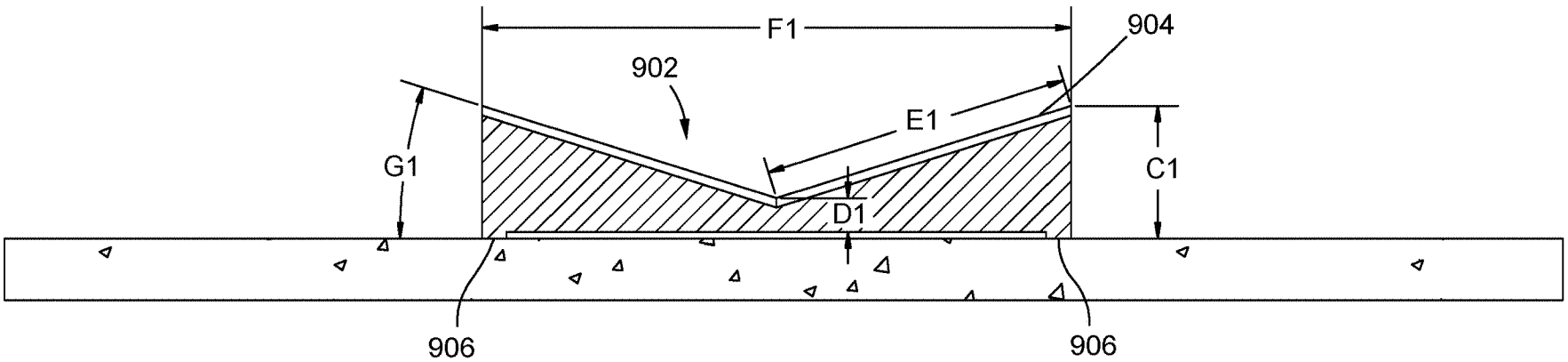
FIG. 10 illustrates an ankle box in accordance with a fourth embodiment of the invention.

FIG. 10 illustrates an ankle box 902 in accordance with another embodiment of the invention. The ankle box 902 again has a top, a bottom, opposing sides, and projections 906 extending from the bottom. In contrast to the ankle box 102 illustrated in FIGS. 1 and 2, the top of this ankle box 906 has an upper surface 904 that has an inverse triangular or "V" shape, with a first half (from a left end to a center thereof) having an downwardly extending (and in one embodiment, generally constant) slope, and a second half (from the center to the other end) having a upwardly extending (and in one embodiment, generally constant) slope. This ankle box 902 may thus be referred to as a "V" shaped ankle box.

Figure 11:
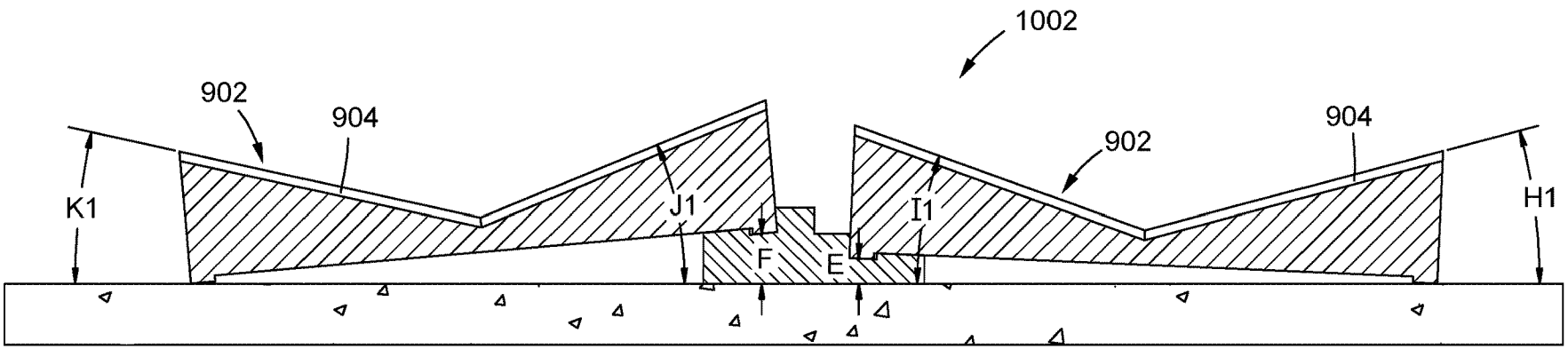
FIG. 11 illustrates a system including a riser and ankle boxes in accordance with the fourth embodiment of the invention.

As illustrated in FIGS. 10 and 11, a distance Cl may be 10 13/16 inches. A distance D1 may be 2 13/16 inches. A distance E1 may be 25 1/8 inches. A distance F1 may be 48 inches. An angle G1 may be 17.4 degrees.

FIG. 11 illustrates a system 1002 in accordance with another embodiment of the invention. The system 1002 includes two of the ankle boxes 902 and a riser 202. The riser 202 has a same configuration as the riser 202 of FIGS. 3 and 5. The ankle boxes 902 have a same configuration as the ankle box 902 of FIG. 10.

In a similar manner to the system 302 of FIG. 4, the system 602 of FIG. 7, and the system 802 of FIG. 9, the system 1002 allows a user to raise one end of the ankle boxes 902 by lifting a right or left end of the ankle box 902 and placing the corresponding projection 906 onto the riser 202 (and preferably onto the upper surface 210 in the first slot 230 or onto the upper surface 216 in the second slot 232). In the embodiment illustrated, the right or left ends of the ankle boxes 902 can be raised by distance E of 2 inches or distance F of 4 inches.

When the ankle box 1002 is raised 2 inches, as shown by the rightmost ankle box 1002 in FIG. 11, angle H1 becomes 14.9 degrees and the angle I1 becomes 19.8 degrees. When the ankle box 1002 is raised 4 inches, as shown by the leftmost ankle box 1002 in FIG. 11, angle J1 becomes 22.4 degrees and angle K1 becomes degrees 12.3.

In one embodiment of the invention, two or more of the ankle boxes may be configured with upper surfaces which are complementary in shape. For example, the ankle box 102 has a convex shape while the ankle box 502 has a concave shape. The convex and concave shapes may be configured such that the convex ankle box 102 can be flipped upside down and fit precisely within/on the concave ankle box 502. Likewise, the ankle box 502 has a triangular shape while the ankle box 902 has an inverse triangular shape. The triangular and inverse triangular shapes may be configured such that the "V"-shaped ankle box 502 can be flipped upside down and fit precisely within/on the inverse triangular ankle box 502. This can provide for easier storage of the ankle boxes.

As indicated herein, the ankle box system as described in the embodiments allows a user to raise a side of an ankle box to one of a plurality of levels or elevations, by placing the left or right ends (and associated projection) on one of the upper surfaces or levels of the riser 202. The embodiments described herein describe a riser 202 having two levels, one having an elevation of 2 inches and another of 4 inches, allowing the left or right end of an ankle box to be raised by 2 or 4 inches. However, the riser 202 might have any plurality of levels or heights (including three or more) and the levels might have various elevations.

By utilizing the riser to raise one end of an ankle box, a user can easily adjust the slope of the top surface of each ankle box, so that when a user stands on the top surface, their ankle(s) have different orientations. This allows the user to move through a progression of increased angles and slopes utilizing various ankle box combinations, configurations and elevations from the base position. For example, as shown herein, the angles of various portions of the ankle boxes change when one end of the ankle box is raised using one of the levels of the riser 202. This allows the user to easily vary the ankle exercises by using the system with an ankle box flat one the floor, with one end of the ankle box raised to a first level, or with one end of the ankle box raised to a second level. The user can move along the ankle box and experience different grades or slopes as applied to the user's ankle in this manner.

The riser is also configured to have one (or more) levels on each of the left and right end thereof. By having levels on each end, the riser 202 can be used to raise one end of a first ankle box to a first level and an end of a second ankle box to a second level. The ankle boxes used may be of a same configuration, such as two of the convex ankle boxes of FIG. 4. Alternatively, a user could use the riser 202 with different ankle boxes, such as (such as a convex ankle box at one end and a triangular ankle box at the other end), allowing the user to do exercises of a first type on the first side and exercises of a second type on the second side without having to further change the configuration.

The ankle boxes of the invention may be used by a user in a variety of manners, such as in a variety of rehabilitory, prehabilitory and strengthening exercises. For example, a user may walk from one end of an ankle box to the other (e.g. while their feet are pointed parallel to a direction from end to end of the ankle box), including while carrying one or more objects, such as weights. A user might also side-step across the ankle box from one end to the other (e.g. while their feet are pointed perpendicular to a direction from end to end of the ankle box), including while carrying one or more objects, such as weights. Of course, a user might perform various other exercises, including where either one or both feet are located on the ankle boxes (including walking, running, hopping or jumping).

In one embodiment, a system of the invention may comprise at least two ankle boxes, such as two of the same ankle box or at least two different ankle boxes, such as at least one of each of the convex, concave, "V"-shaped and inverted V shaped ankle boxes, with or without a riser. The ankle boxes might be placed end-to-end, whereby the user might traverse the ankle boxes in succession.

In a preferred embodiment, the ankle boxes have a length-wise direction from end to end and one end is designed to be raised using the riser. It is possible for the riser to be configured to allow a side of an ankle box to be placed on the riser, thereby changing the elevation or slope of the ankle box from side-to-side.

In a preferred embodiment, the ankle boxes interconnect with a riser by having one or more projections fit within a slot of the riser. This configuration maintains the ankle box in contact with the riser during use (for example, the ankle box won't merely slide off of the riser due to this interconnection). However, other means might be utilized to interconnect the ankle boxes with the riser. For example, the projections might have the form of pins which may be located in holes in upper surfaces of the riser. In another embodiment, the riser might define upwardly extending tabs that fit into slots or holes in the bottom of the ankle boxes. Also, the ankle boxes might be placed onto the riser and then pinned or locked into place with connectors.

Of course, other ankle boxes might be provided in accordance with the invention, such as ankle boxes having differently shaped upper surfaces. For example, an upper surface of an ankle box might be "W" shaped.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. An ankle box system configured for exercising a human ankle comprising:

at least one ankle box having an upper surface and a lower surface, and at least one projection extending from the lower surface; and a riser having a bottom surface and a plurality of riser levels, each of the riser levels configured for selectively receiving the at least one projection of at least one of the ankle boxes, at least one of the riser levels having an upper surface being disposed at a different distance from the bottom surface of the riser than other ones of the upper surfaces of the riser levels, wherein each of the riser levels includes the upper surface of the riser level and inner and outer side walls extending upward from the upper surface of the riser level, wherein the upper surface of the at least one ankle box has a shape configured to enhance exercising the human ankle.

2. The ankle box system of claim 1, wherein a distance from the upper surface of the riser to the bottom surface of the riser increases when moving from an outer edge of the upper surface of the riser towards a middle of the riser.

3. The ankle box system of claim 1, wherein the riser further includes upper support surfaces extending from the outer side wall of each riser level away from a center of the riser.

4. The ankle box system of claim 3, wherein the upper support surfaces have a downwardly extending slope in a direction extending from the center of the riser towards outer edges of the riser.

5. The ankle box system of claim 3, wherein the slope of the upper support surfaces is configured to receive the lower surface of the ankle box thereon when one of the projections of the riser is disposed on an upper surface of the upper surface of one of the riser levels.

6. The ankle box system of claim 1, wherein the shape of the upper surface of each of the ankle boxes is one of concave, convex, triangular or inverse triangular.

7. The ankle box system of claim 1, wherein a first one of the ankle boxes has an upper surface with a shape complementary to a shape of an upper surface of another one of the ankle boxes.

8. An ankle box system configured for exercising a human ankle comprising:

at least one ankle box having an upper surface and a lower surface, a first end and a second end, and at least one projection extending from the lower surface at the first end; and a riser having a bottom surface and at least a first and a second riser level, each of the riser levels configured for selectively receiving the at least one projection of the first end of the at least one ankle box, the first riser level disposed a different distance from the bottom surface of the riser than the second riser level, whereby when the at least one projection is associated with the first level, the ankle box extends from the second end towards the first end at a first angle, and whereby when the at least one projection is associated with the second level, the ankle box extends from the second end towards the first end at a second angle.

9. The ankle box system of claim 8, wherein the first and second riser levels comprise elongate slots.

10. The ankle box system of claim 8, wherein the at least one projection comprises a downwardly extending foot which extends generally between a first and a second side of the ankle box.

11. The ankle box system of claim 8, wherein the riser has a first end and a second end, the first riser level located at the first end and the second riser level located at the second end.

12. The ankle box system of claim 8, further comprising a raised portion between the first and second riser levels.

13. The ankle box system of claim 8, further comprising a first sloping surface between the first end and the first riser level and second sloping surface between the second end and the second riser level.

14. The ankle box system of claim 8, wherein the first riser level is located above the second riser level and the first sloping surface slopes a first angle greater than the second sloping surface.

15. The ankle box system of claim 8, wherein the shape of the upper surface of each of the ankle boxes is one of concave, convex, triangular or inverse triangular.

16. The ankle box system of claim 8, wherein a first one of the ankle boxes has an upper surface with a shape complementary to a shape of an upper surface of another one of the ankle boxes.

17. The ankle box system of claim 8, wherein the plurality of ankle boxes comprises at least one of: i) a convex ankle box having a first end and a second end and a top surface which is continuously convex between the first and second ends; ii) a concave ankle box having a first end and a second end and a top surface which is continuously convex between the first and second ends, iii) a triangular ankle box having a first end and a second end and a first upwardly extending surface which slopes upwardly from the first end and meets a second upwardly extending surface which slopes upwardly from the second end; and iv) an inverse triangular ankle box having a first end and a second end and a first downwardly extending surface which slopes downwardly from the first end and meets a second downwardly extending surface which slopes downwardly from the second end.

18. The ankle box system of claim 17, wherein the at least one projection comprises a foot extending downwardly from the first end and the second end of the plurality of ankle boxes.

19. The ankle box system of claim 8, wherein the upper surface of the at least one ankle box is non-planar.

* * * * *